US010401045B2

(12) United States Patent
Koop

(10) Patent No.: US 10,401,045 B2
(45) Date of Patent: Sep. 3, 2019

(54) ZONE BALANCING DAMPER AND METHOD OF OPERATION

(71) Applicant: Air Distribution Technologies IP, LLC, Milwaukee, WI (US)

(72) Inventor: Edward N. Koop, Olathe, KS (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 967 days.

(21) Appl. No.: 14/179,753

(22) Filed: Feb. 13, 2014

(65) Prior Publication Data

US 2015/0226448 A1 Aug. 13, 2015

(51) Int. Cl.
*F24F 11/74* (2018.01)
*F24F 13/14* (2006.01)

(52) U.S. Cl.
CPC ..... *F24F 11/74* (2018.01); *F24F 13/14* (2013.01)

(58) Field of Classification Search
CPC ..... G05D 7/012; G05D 7/0133
USPC ..... 138/46
See application file for complete search history.

(56) References Cited

U.S. PATENT DOCUMENTS

| | | | | |
|---|---|---|---|---|
| 3,627,261 | A * | 12/1971 | Ludeman | F16K 1/22 251/305 |
| 3,669,152 | A * | 6/1972 | Peterson | 138/46 |
| 4,095,534 | A * | 6/1978 | Goidich | 110/263 |
| 4,605,198 | A | 8/1986 | Greiner | |
| 5,465,756 | A * | 11/1995 | Royalty et al. | 137/625.31 |
| 5,697,596 | A | 12/1997 | Kremers et al. | |
| 6,105,927 | A * | 8/2000 | Zelczer et al. | 251/58 |
| 6,273,141 | B1 * | 8/2001 | DeSellem | 138/46 |
| 7,114,486 | B2 * | 10/2006 | Hannewald | F02D 9/1025 123/337 |
| 7,513,823 | B1 * | 4/2009 | Dix | 454/333 |
| 7,571,742 | B2 * | 8/2009 | Horner | F16K 1/22 123/337 |
| 8,333,219 | B2 * | 12/2012 | Holstad | 138/90 |
| 8,430,731 | B2 | 4/2013 | Bamberger | |
| 2004/0238045 | A1 * | 12/2004 | Van Becelaere | 137/557 |
| 2007/0218830 | A1 * | 9/2007 | Baik | 454/323 |
| 2010/0105312 | A1 * | 4/2010 | Bamberger | F24F 13/14 454/266 |
| 2011/0036438 | A1 * | 2/2011 | Jaromin et al. | 138/89 |
| 2012/0103453 | A1 * | 5/2012 | Buseyne et al. | 138/46 |

FOREIGN PATENT DOCUMENTS

| | | |
|---|---|---|
| EP | 0501073 | 9/1992 |

* cited by examiner

*Primary Examiner* — Vishal Pancholi
(74) *Attorney, Agent, or Firm* — Fletcher Yoder, P.C.

(57) ABSTRACT

A damper comprising a tubular duct, a circular blade disposed within the tubular duct and a shaft disposed within the tubular duct, wherein the shaft extends through a hole in the circular blade.

20 Claims, 8 Drawing Sheets

ZONE BALANCING DAMPER AND METHOD OF OPERATION

TECHNICAL FIELD

The present disclosure relates to heating, ventilation and air conditioning (HVAC) systems, and more specifically to a zone balancing damper for an HVAC system.

BACKGROUND OF THE INVENTION

Dampers having a so-called "butterfly" design for circular HVAC ducts rotate about an axis that bisects the damper, and the damper swivels about the axis within the duct. As such, the damper can encounter a significant drag force as it is opened and closed within the duct, which increases the amount of torque and corresponding energy required to open and close the damper.

SUMMARY OF THE INVENTION

A damper is provided that includes a tubular duct, a circular blade disposed within the tubular duct and a shaft disposed within the tubular duct, wherein the shaft extends through a hole in the circular blade. The damper can be opened and closed by rotating the circular blade 180 degrees.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
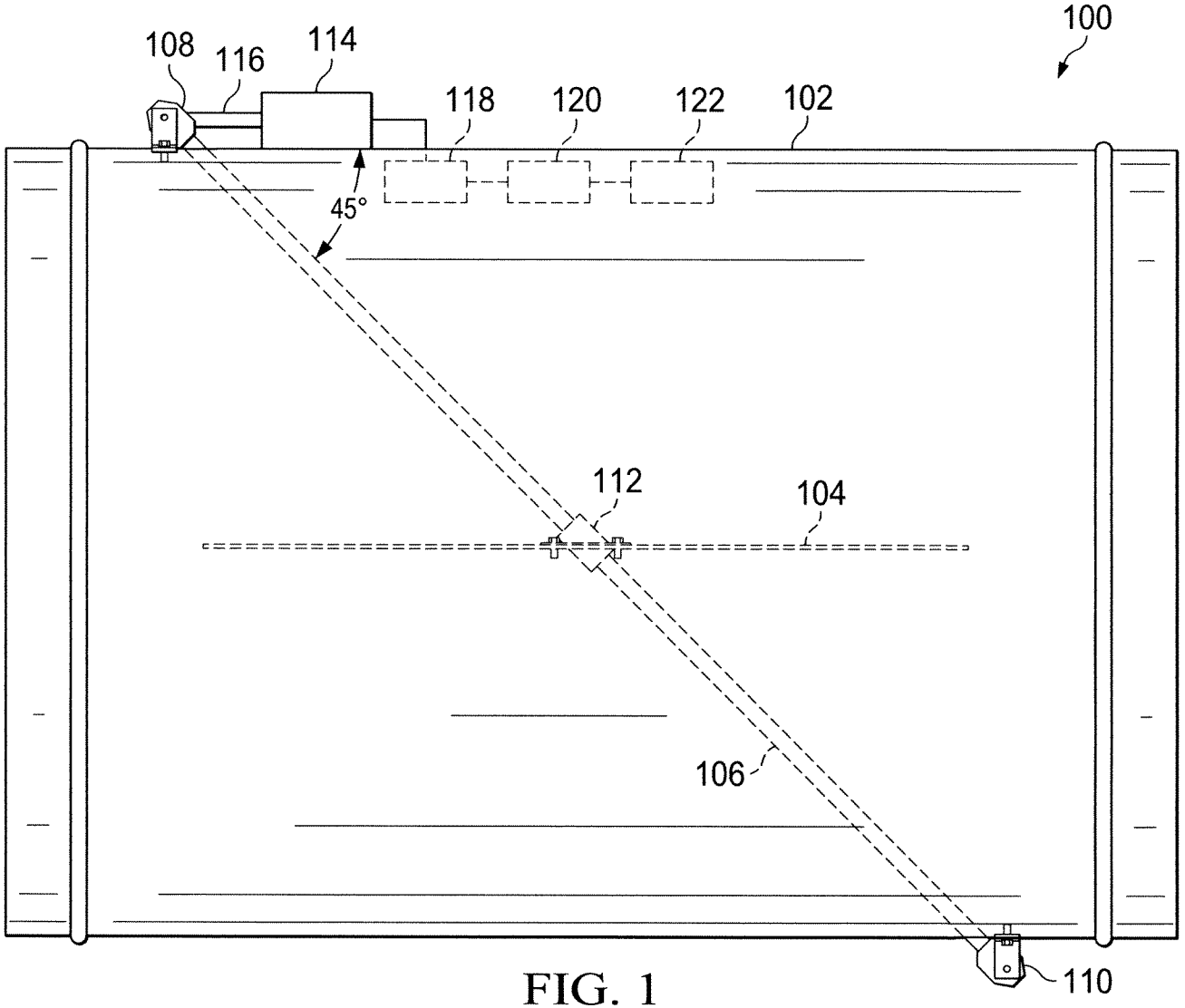
FIG. 1 is a side view of a zone balancing damper having a 45 degree incline, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a side view of a zone balancing damper 100 having a 45 degree incline, in accordance with an exemplary embodiment of the present disclosure. Zone balancing damper 100 can be constructed from steel or other suitable materials, and can be formed by cutting, molding, punching, welding, die casting or in other suitable manners.

Zone balancing damper 100 is disposed within tubular duct 102, which can be an HVAC duct or other suitable ducts. Blade 104 of zone balancing damper 100 is a circular assembly having an outer diameter slightly less than the inner diameter of circular duct 102 (clearance fit), and is mounted to shaft 106 by coupling 112, which can be bolted, welded or otherwise suitably connected to shaft 106 and blade 104. Shaft 106 is mounted at an angle of 45 degrees to tubular duct 102, as shown, and is secured on either end by bearings 108 and 110, but can alternatively be supported in cantilever fashion from a single end. Bearings 108 and 110 can be motorized, or can be coupled to motor 114 by drive shaft 116 or other suitable mechanical energy transfer devices, such as gears, chains or belts. An energy recovery system 118 can be disposed within tubular duct 102, where the energy recovered by energy recovery system 118 is used to provide power for motor 114. The energy can be stored in electrical form in battery 120 or a suitable capacitive or non-battery energy storage device, and wireless controller 122 is used to receive open and close controls, to transmit damper position data, and to perform other suitable functions. Energy recovery system 118 can be a propeller-driven electrical generator or other suitable energy recovery systems, and allows zone balancing damper 100 to be wirelessly controlled and powered without the need for running wiring to the location of zone balancing damper 100 for power, control, position data communications or other typical purposes.

In operation, blade 104 can be rotated from a full open position at which it is disposed on edge within tubular duct 102 to a full closed position at which it fully blocks tubular duct 102. As blade 104 is rotated, the maximum torque moment on shaft 106 is equal to the vector dot product of the moment acting on blade 104 and axis of shaft 106, which is obtained by the equation:

$$T_{shaft}=T_{blade}\cos(A)$$

where A is the angle between the plane of blade 104 and the axis of shaft 106 (the moment on the blade is not necessarily in the plane of the page as shown in FIG. 1). Based on this relationship, it can be seen that a damper with shaft 106 at 45 degrees to the plane of blade 104 transmits 29 percent less torque to shaft 106 from blade 104, and a damper with shaft 106 at 60 degrees to the plane of blade 104 would transmit 50 percent less torque to shaft 106 from blade 104.

In addition, unlike prior art butterfly damper configurations that go from full open to full closed with a 90 degree rotation of the shaft, the zone balancing damper of the present disclosure goes from full open to full closed with 180 degrees of rotation of the shaft. This operational characteristic helps to reduce the amount of torque that is required to be transmitted to the shaft by increasing the angular distance over which the torque is applied.

Figure 2:
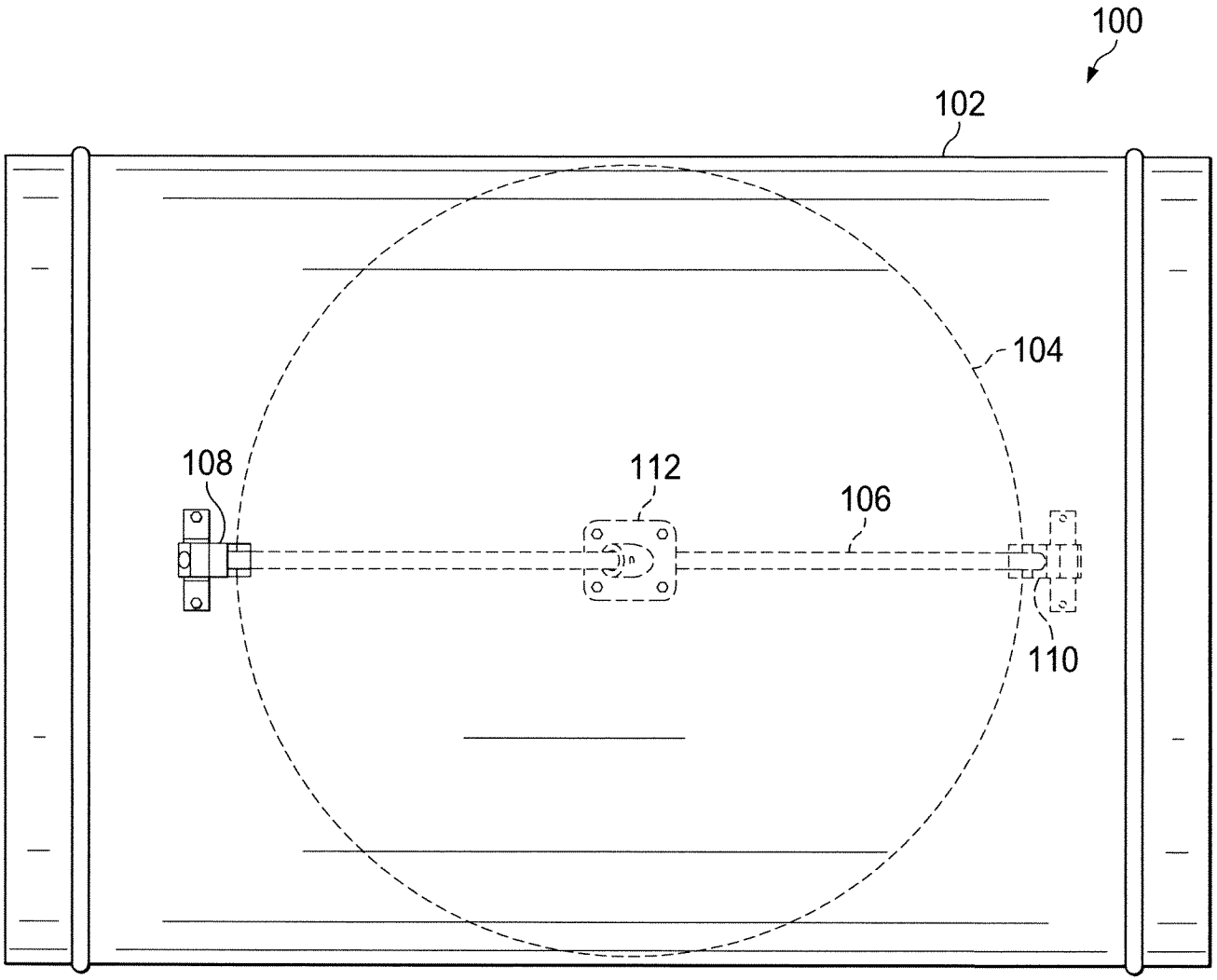
FIG. 2 is an overhead view of the zone balancing damper having a 45 degree incline, in accordance with an exemplary embodiment of the present disclosure.

FIG. 2 is an overhead view of a zone balancing damper 100 in accordance with an exemplary embodiment of the present disclosure. The circular shape of blade 104 can be seen in FIG. 2, as well as the relative position of shaft 106 to blade 104. Blade 104 is in the full open position as shown, with the plane of blade 104 parallel to the axis of tubular duct 102.

Figure 3:
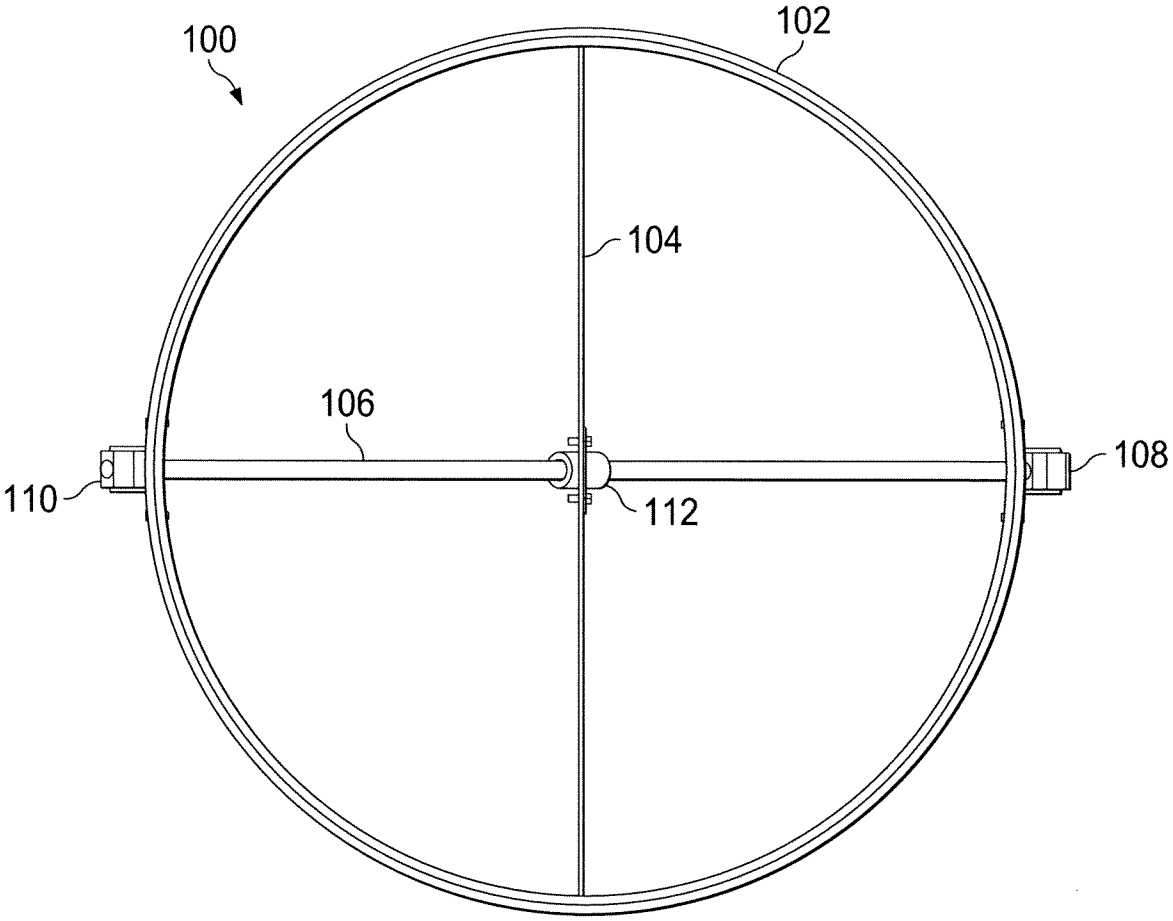
FIG. 3 is an end view of the zone balancing damper having a 45 degree incline, in accordance with an exemplary embodiment of the present disclosure.

FIG. 3 is an end view of a zone balancing damper 100 in accordance with an exemplary embodiment of the present disclosure. The view shown in FIG. 3 is looking into the end of tubular duct 102, and blade 104 is again in the full open position and is viewed from the plane of blade 104. The angular relationship between shaft 106, blade 104 and tubular duct 102 cannot be seen in this view.

Figure 4:
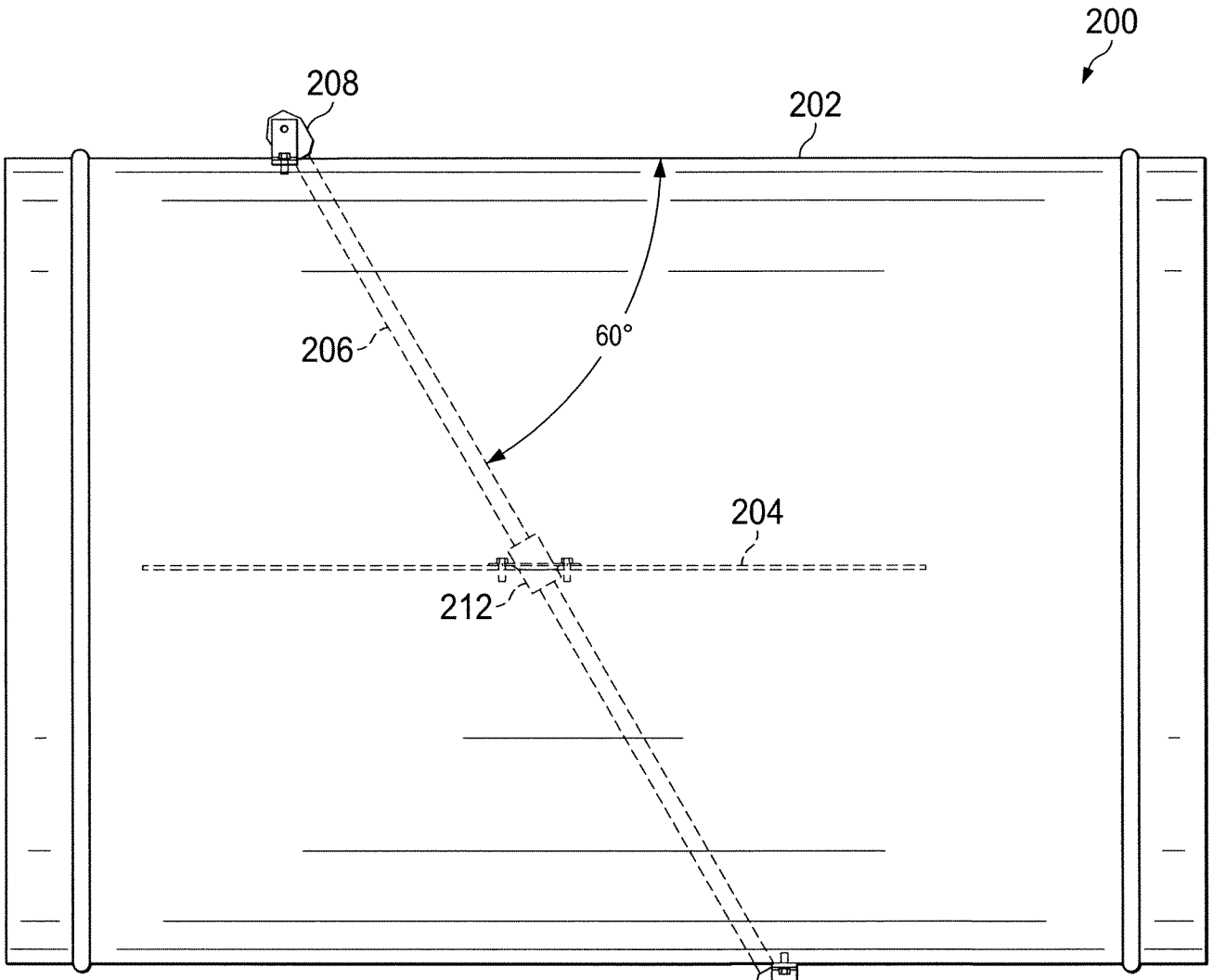
FIG. 4 is a side view of a zone balancing damper having a 60 degree incline, in accordance with an exemplary embodiment of the present disclosure.

FIG. 4 is a side view of a zone balancing damper 200 having a 60 degree incline, in accordance with an exemplary embodiment of the present disclosure. Zone balancing damper 200 can be constructed from steel or other suitable materials, and can be formed by cutting, molding, punching, welding, die casting or in other suitable manners.

Zone balancing damper 200 is disposed within tubular duct 202, which can be an HVAC duct or other suitable ducts. Blade 204 of zone balancing damper 200 is a circular assembly having an outer diameter slightly less than the inner diameter of tubular duct 202 (clearance fit), and is mounted to shaft 206 by coupling 212, which can be bolted, welded or otherwise suitably connected to shaft 206 and blade 204. Shaft 206 is mounted at an angle of 60 degrees to tubular duct 202, as shown, and is secured on either end by bearings 208 and 210, but can alternatively be supported in cantilever fashion from a single end.

In operation, blade 204 can be rotated from a full open position at which it is disposed on edge within tubular duct 202 to a nearly closed position at which it mostly blocks tubular duct 202. Because zone balancing damper 200 is used for zone balancing, it Is not necessary for it to be fully open or fully close, such that the steeper angle of the shaft can result in a greater reduction in the actuation torque.

Figure 5:
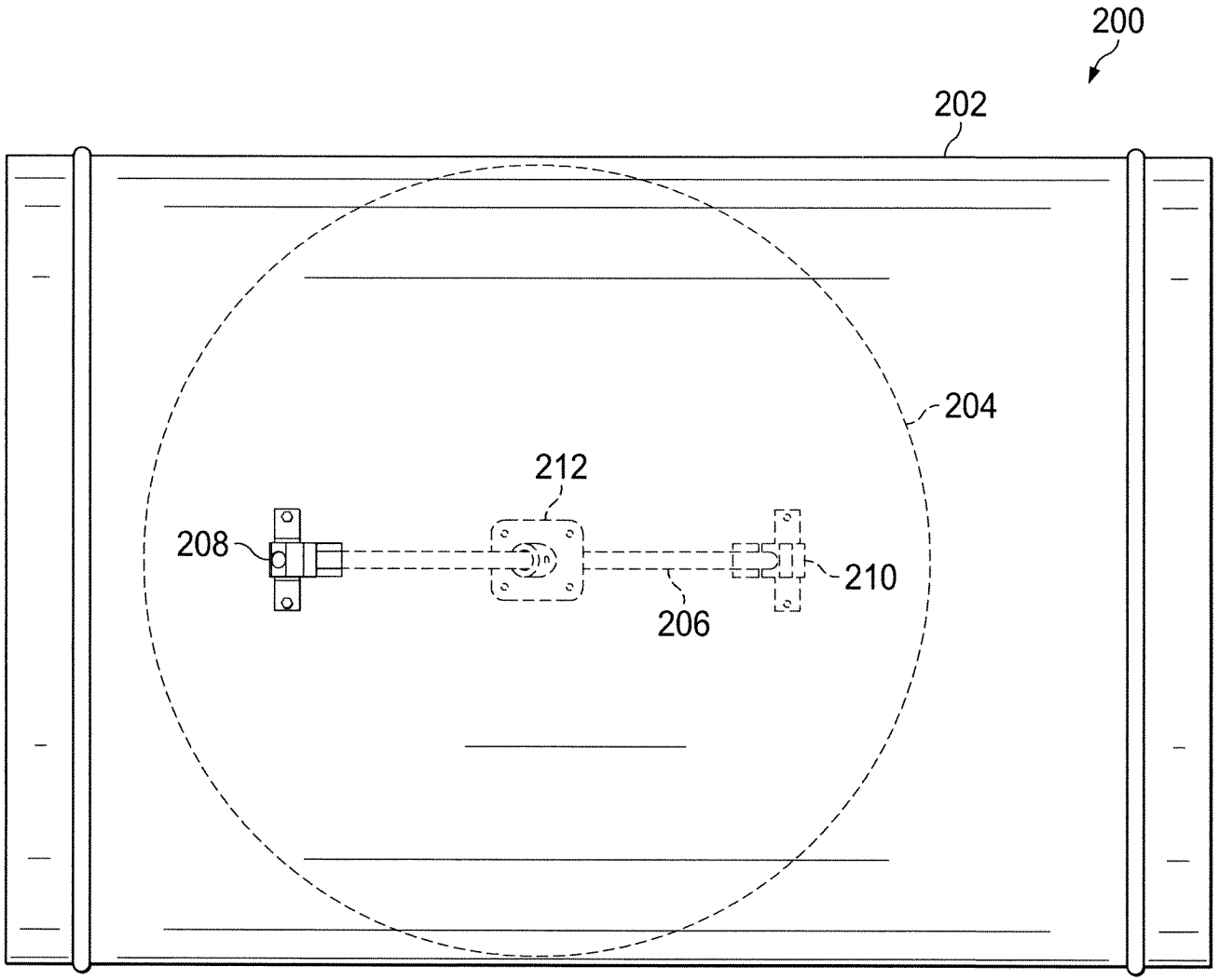
FIG. 5 is an overhead view of the zone balancing damper having a 60 degree incline, in accordance with an exemplary embodiment of the present disclosure.

FIG. 5 is an overhead view of a zone balancing damper 200 in accordance with an exemplary embodiment of the present disclosure. The circular shape of blade 204 can be seen in FIG. 5, as well as the relative position of shaft 206 to blade 204. Blade 204 is in the full open position as shown, with the plane of blade 204 parallel to the axis of tubular duct 202.

Figure 6:
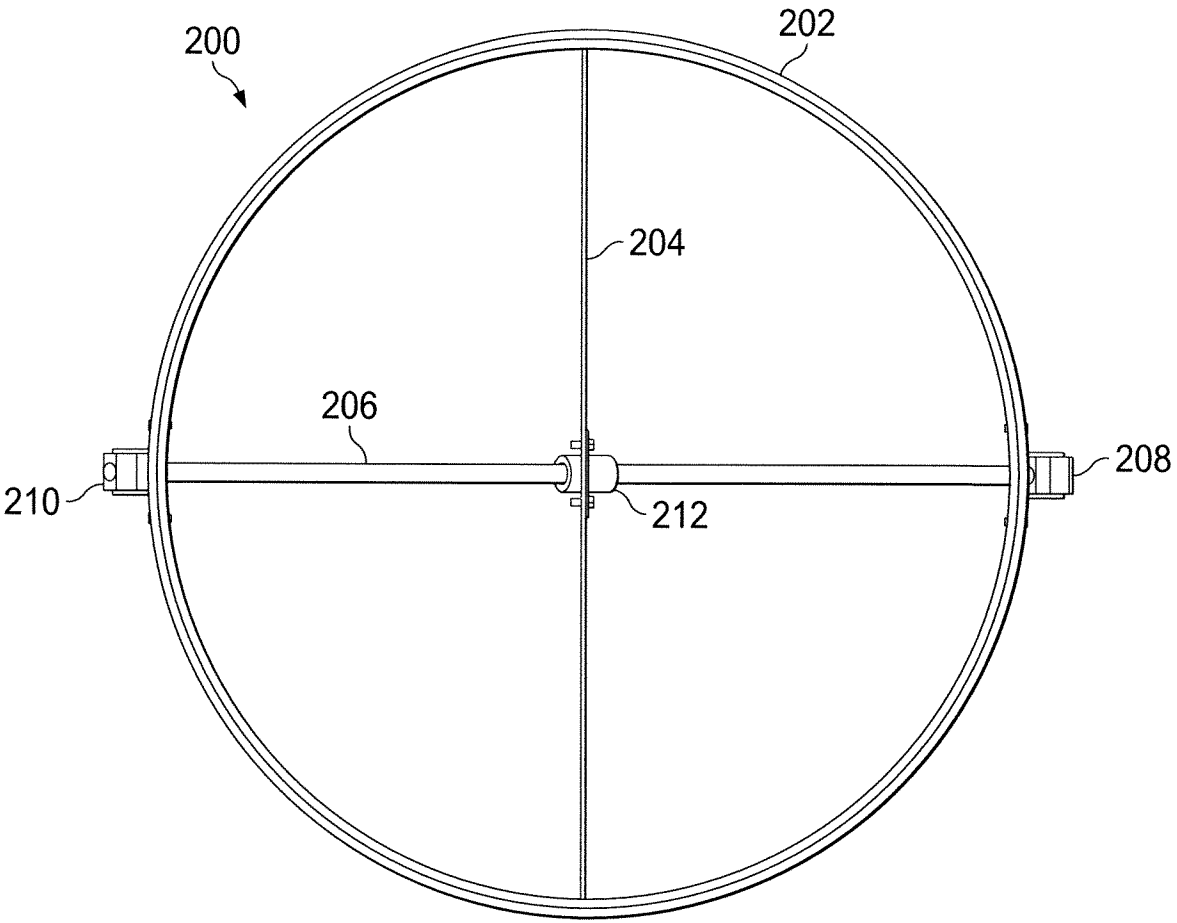
FIG. 6 is an end view of the zone balancing damper having a 60 degree incline, in accordance with an exemplary embodiment of the present disclosure.

FIG. 6 is an end view of a zone balancing damper 200 in accordance with an exemplary embodiment of the present disclosure. The view shown in FIG. 6 is looking into the end of tubular duct 202, and blade 204 is again in the full open position and is viewed from the plane of blade 204. The angular relationship between shaft 206, blade 204 and tubular duct 202 cannot be seen in this view.

Figure 7:
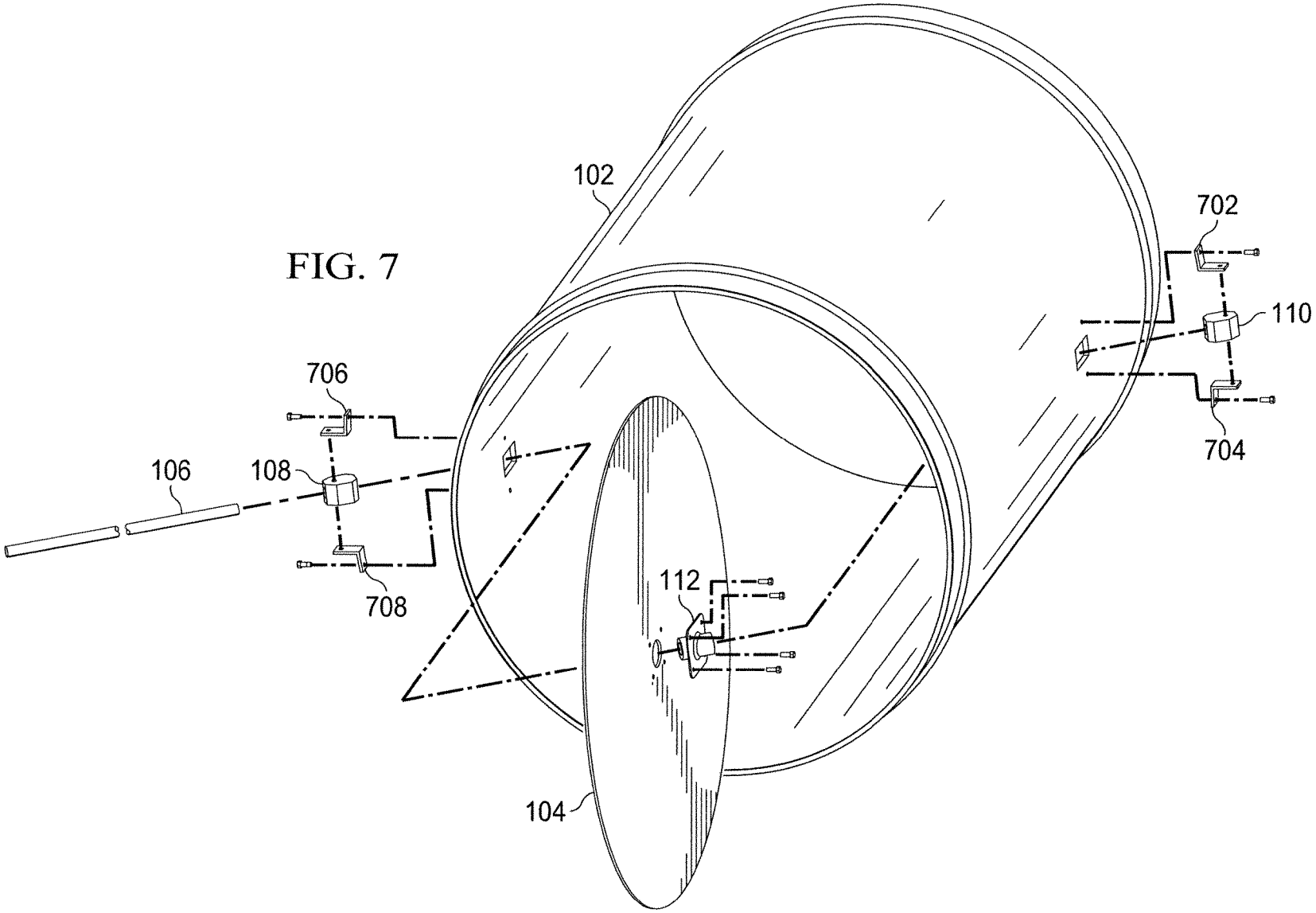
FIG. 7 is an exploded view of a zone balancing damper in accordance with an exemplary embodiment of the present disclosure.

FIG. 7 is an exploded view 700 of a zone balancing damper in accordance with an exemplary embodiment of the present disclosure. As shown in FIG. 7, bearing 108 is coupled to tubular duct 102 by brackets 706 and 708, which are secured to tubular duct 102 by rivets, bolts, screws or in other suitable manners. Shaft 106 extends from bearing 108 through blade 104 and coupling 112, which is secured to blade 104 by rivets, bolts, screws or in other suitable manners. Shaft 106 then terminates in bearing 110, which is coupled to tubular duct 102 by brackets 702 and 704, which are secured to tubular duct 102 by rivets, bolts, screws or in other suitable manners.

Figure 8:
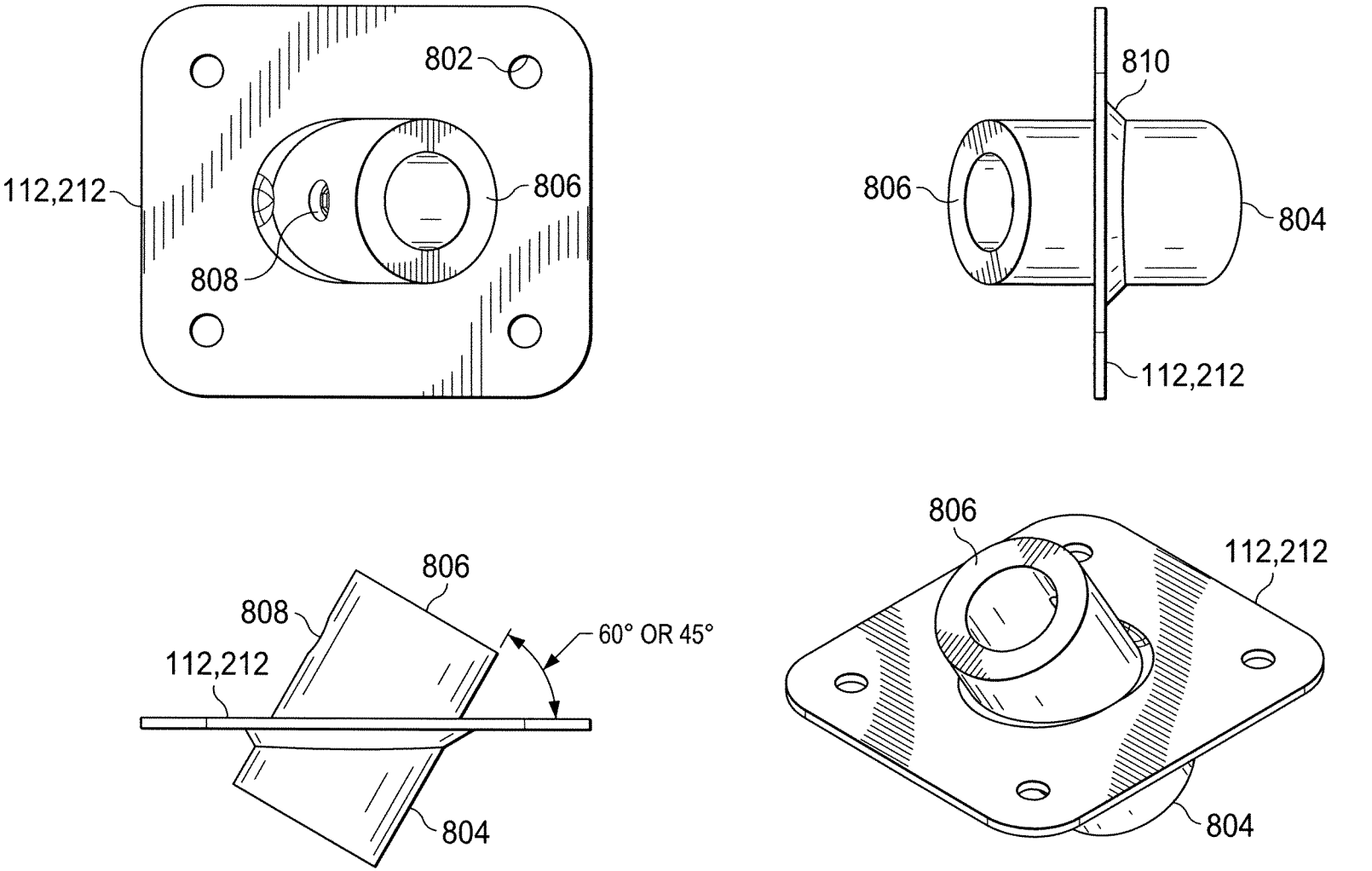
FIG. 8 is a detail diagram of zone balancing damper components in accordance with an exemplary embodiment of the present disclosure.

FIG. 8 is a detail diagram of zone balancing damper components in accordance with an exemplary embodiment of the present disclosure. Coupling 112 or 212 includes four mounting holes 802, which are used to secure coupling 112 or 212 to blade 104 or 204, respectively. Bushing 806 includes set screw 808, which is used to secure shaft 106 or 206 into place. Bushing 806 is disposed at an angle of 45 degrees or 60 degrees to the base of coupling 112 or 212, respectively, and is secured by fillet weld 810.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A damper comprising:
a tubular duct;
a circular blade disposed within the tubular duct; and
a shaft disposed within the tubular duct, wherein the shaft extends through a hole in the circular blade.

2. The damper of claim 1 further comprising a bushing disposed around the hole in the circular blade.

3. The damper of claim 2 wherein the bushing is secured to the circular blade.

4. The damper of claim 2 wherein the bushing is secured to the shaft.

5. The damper of claim 1 further comprising a bearing disposed on the tubular duct, wherein a first end of the shaft terminates in the bearing.

6. The damper of claim 1 further comprising a motor coupled to the shaft.

7. The damper of claim 6 further comprising an energy recovery system disposed with in the tubular duct, wherein the energy recovery system is configured to deliver electrical energy to the motor.

8. The damper of claim 7, further comprising a wireless controller coupled to the energy recovery system, the wireless controller configured to receive wireless control data to change a position of the circular blade within the tubular duct.

9. The damper of claim 1 further comprising:
a first bearing disposed on the tubular duct, wherein a first end of the shaft terminates in the first bearing; and
a second bearing disposed on the tubular duct, wherein a second end of the shaft terminates in the second bearing.

10. The damper of claim 1, wherein the shaft is disposed at an angle less than 90 degrees relative to an outer surface of the tubular duct.

11. The damper of claim 1, wherein the shaft is disposed at an angle between 45 degrees and 60 degrees relative to an outer surface of the tubular duct, at a point of interface between the shaft and the outer surface.

12. A damper comprising:
a tubular duct;
a circular blade disposed within the tubular duct;
a bushing disposed around a hole in the circular blade and secured to the circular blade;
a shaft disposed within the tubular duct, wherein the shaft extends through the hole in the circular blade and the bushing and the shaft is secured to the bushing, and the shaft is disposed at an angle less than 90 degrees relative to an outer surface of the tubular duct;

a first bearing disposed on the tubular duct, wherein a first end of the shaft terminates in the first bearing;

a second bearing disposed on the tubular duct, wherein a second end of the shaft terminates in the second bearing;

a motor coupled to the shaft;

an energy recovery system disposed with in the tubular duct, wherein the energy recovery system is configured to deliver electrical energy to the motor;

a wireless controller coupled to the energy recovery system, the wireless controller configured to receive wireless control data to change a position of the circular blade within the tubular duct.

13. A damper comprising:

a circular blade configured to be disposed within a tubular duct;

a shaft configured to be disposed within the tubular duct; and wherein the shaft extends through a hole in the circular blade and is configured to rotate 180 degrees from a fully open position to a fully closed position.

14. The damper of claim 13 further comprising a bushing disposed around the hole in the circular blade.

15. The damper of claim 14 wherein the bushing is secured to the circular blade.

16. The damper of claim 14 wherein the bushing is secured to the shaft.

17. The damper of claim 13 further comprising a bearing disposed on the tubular duct, wherein a first end of the shaft terminates in the bearing.

18. The damper of claim 13 further comprising a motor coupled to the shaft.

19. The damper of claim 18 further comprising an energy recovery system disposed with in the tubular duct, wherein the energy recovery system is configured to deliver electrical energy to the motor.

20. The damper of claim 19, further comprising a wireless controller coupled to the energy recovery system, the wireless controller configured to receive wireless control data to change a position of the circular blade within the tubular duct.

* * * * *